US007503183B2

(12) United States Patent
Bussjager

(10) Patent No.: US 7,503,183 B2
(45) **Date of Patent: *Mar. 17, 2009**

(54) TWO PHASE OR SUBCOOLING REHEAT SYSTEM

(75) Inventor: Ruddy C. Bussjager, Cicero, NY (US)

(73) Assignee: Carrier Corporation, Farmington, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/496,829

(22) Filed: Jul. 31, 2006

(65) Prior Publication Data

US 2007/0022766 A1 Feb. 1, 2007

Related U.S. Application Data

(63) Continuation of application No. PCT/US2005/018164, filed on May 24, 2005, which is a continuation of application No. 10/852,368, filed on May 24, 2004, now Pat. No. 7,043,930, which is a continuation-in-part of application No. 10/769,198, filed on Jan. 30, 2004, now abandoned.

(51) Int. Cl.

| | |
|---|---|
| ***F25D 17/06*** | (2006.01) |
| ***F25D 21/06*** | (2006.01) |
| ***F25B 41/00*** | (2006.01) |
| ***F25B 49/00*** | (2006.01) |

(52) U.S. Cl. ..... 62/196.4; 62/93; 62/113

(58) Field of Classification Search ..... 62/196.4, 62/93, 113, 224, 225, 222

See application file for complete search history.

(56) References Cited

U.S. PATENT DOCUMENTS

| | | | | |
|---|---|---|---|---|
| 3,798,920 | A * | 3/1974 | Morgan | 62/173 |
| 5,651,258 | A * | 7/1997 | Harris | 62/90 |
| 6,427,461 | B1 * | 8/2002 | Whinery et al. | 62/176.6 |
| 6,826,921 | B1 * | 12/2004 | Uselton | 62/176.6 |
| 2004/0089002 | A1 * | 5/2004 | Rayburn | 62/176.1 |

OTHER PUBLICATIONS

Chinese Office Action dated Dec. 7, 2007, for Chinese Patent No. 200580016571.3.

* cited by examiner

*Primary Examiner*—Chen-Wen Jiang
(74) *Attorney, Agent, or Firm*—Bachman & LaPointe, P.C.

(57) ABSTRACT

A method for removing humidity from air comprising the steps of providing an air conditioning system comprising a continuous circuit through which a refrigerant flows from a compressor, through a condenser, through a heat exchanger, through an evaporator, and returning to the compressor, providing a bypass valve through which a portion of the refrigerant flows around the heat exchanger, providing a bypass circuit through which a portion of the refrigerant flows from a point upstream of the condenser to mix with the refrigerant at a point downstream of the condenser, providing a discharge gas valve for controlling the portion of the refrigerant flowing through the bypass circuit, measuring an outdoor temperature and a relative humidity, determining a cooling stage and operating the bypass valve and the discharge gas valve to remove a portion of the humidity from the air based upon the outdoor temperature, the relative humidity, and the cooling stage.

10 Claims, 3 Drawing Sheets

TWO PHASE OR SUBCOOLING REHEAT SYSTEM

CROSS REFERENCE TO RELATED APPLICATION

This application is a continuation of International Application No. PCT/US2005/018164, which designated the United States and was filed on May 24, 2005, and which is a continuation of U.S. patent application Ser. No. 10/852,368, filed May 24, 2004, and now issued as U.S. Pat. No. 7,043,930, which is a continuation-in-part of U.S. patent application Ser. No. 10/769,198, filed Jan. 30, 2004, now abandoned.

BACKGROUND OF THE INVENTION

The invention relates to a method for increasing the flexibility of air conditioning systems that employ humidity removal.

Conventional air conditioning systems comprise three basic components which function in unison to provide cooling. These three system components include the compressor, the condenser, and the evaporator. With reference to FIG. 1, there is illustrated an air conditioning system 10 known in the art. The air conditioning system 10 moves a working fluid, or refrigerant, via a continuous closed network 23 through these operational components in a continuous cycle of operation. The refrigerant is typically composed of Freon but may consist of any fluid, such as alcohol or the like, capable of accepting and giving up heat energy as its temperature increases and decreases and as its state changes between a gas and a liquid.

Refrigerant enters the compressor 11 as a low pressure and temperature gas and is compressed. After compression, the refrigerant leaves the compressor 11 as a high temperature and pressure gas.

The refrigerant moves in its gaseous state to the condenser 13. At the condenser 13, the received refrigerant gas decreases in energy at a constant pressure and becomes totally subcooled as it leaves the condenser. Thereafter, the liquid refrigerant proceeds to the evaporator 17.

At the evaporator 17, the refrigerant pressure is reduced by expansion device 16. In the evaporator, energy is picked up from the air stream and the refrigerant leaves in a gaseous state. At the evaporator 17, the air to be cooled is, for example, initially at about 80 degrees Fahrenheit. Such air is moved by a fan through the evaporator 17 and becomes cooled to about 50 to 55 degrees Fahrenheit or lower.

Often times when the air requires greater dehumidification, heat exchanger 15 is provided to further subcool the refrigerant. The air passing over evaporator 17 exhibits more in latent and sensible cooling with the heat exchanger energized. However, the energy removed from the refrigerant by heat exchanger 15 is returned to the air stream after the air leaves evaporator 17. Thus, with heat exchanger 15 energized, the air leaving is at a higher dry bulb temperature (less sensible) and is low moisture centered (more latent), than with heat exchanger 15 unenergized.

SUMMARY OF THE INVENTION

Accordingly, it is an object of the present invention to provide a method for increasing the flexibility of air conditioning systems that employ humidity removal.

In accordance with the present invention, a method for removing humidity from air comprises the steps of providing an air conditioning system comprising a continuous circuit through which a refrigerant flows from a compressor, through a condenser, through a heat exchanger, through an evaporator, and returning to the compressor, providing a bypass valve through which a portion of the refrigerant flows around the heat exchanger, providing a bypass circuit through which a portion of the refrigerant flows from a point upstream of the condenser to mix with the refrigerant at a point downstream of the condenser, providing a discharge gas valve for controlling the portion of the refrigerant flowing through the bypass circuit, measuring an outdoor temperature and a relative humidity, determining a cooling stage, and operating the bypass valve and the discharge gas valve to remove a portion of the humidity from the air based upon the outdoor temperature, the relative humidity, and the cooling stage.

In accordance with the present invention, an air conditioning apparatus comprises a continuous circuit through which a refrigerant flows from a compressor, through a condenser, through a heat exchanger, through an evaporator, and returning to the compressor, a bypass valve through which a portion of the refrigerant flows around the heat exchanger, a bypass circuit through which a portion of the refrigerant flows from a point upstream of the condenser to mix with the refrigerant at a point downstream of the condenser, a discharge gas valve for controlling the portion of the refrigerant flowing through the bypass circuit, and a control module for receiving an outdoor temperature, a relative humidity, and a return air temperature and controlling the operation of the compressor, the discharge gas valve, and the bypass valve.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

It is therefore a teaching of the present invention to provide a method, and a system for utilizing such method, for utilizing previously wasted heat in an air conditioning system to negate the undesirable effects of sensible cooling.

It is sometimes desirable to provide no sensible cooling and just remove moisture. In such a case, additional heat is added to the air by energizing valve 19 as illustrated with reference to FIG. 2 which bypasses a portion of the flow around condenser 13. In so doing, heat exchanger 15 becomes a condenser of the 2 phase mixture entering and a subcooler of refrigerant prior to its exit from heat exchanger 15.

Thus with this scheme various levels of moisture removal and sensible cooling are available.

Figure 1:
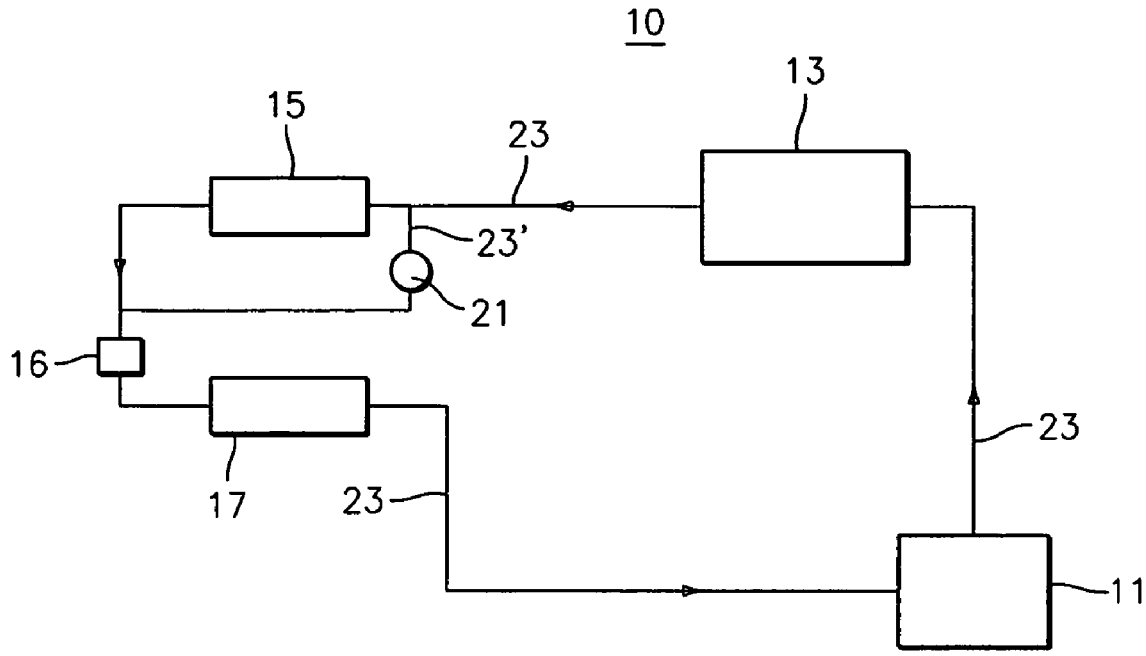
FIG. 1 (PRIOR ART)
FIG. 1 A diagram of an air conditioning system known in the art.
Figure 2:
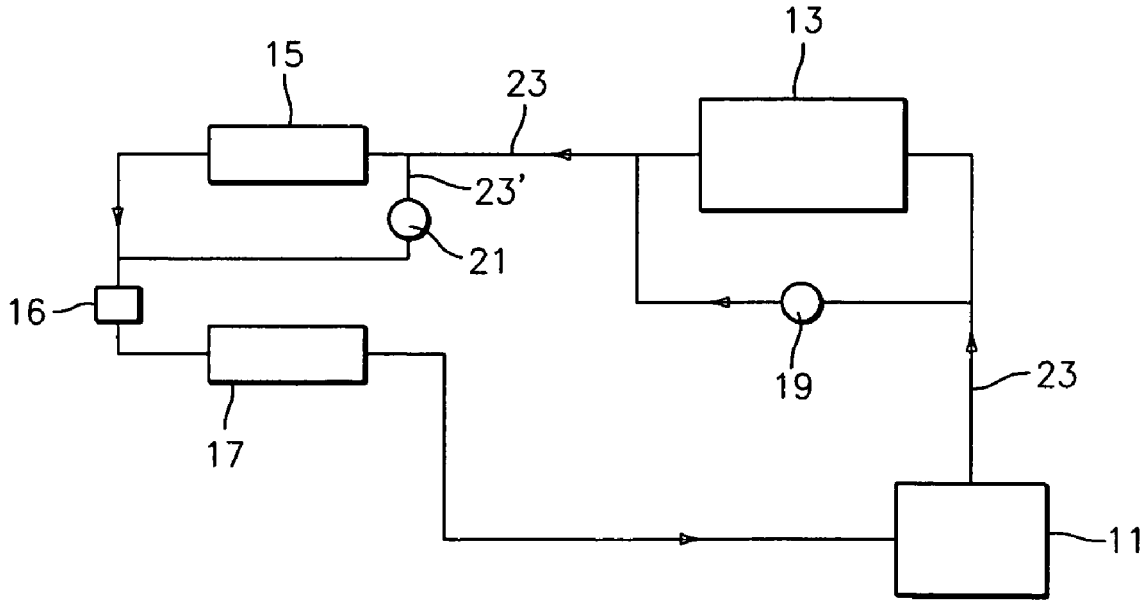
FIG. 2 A diagram of an air conditioning system of the present invention.

With reference to FIG. 2, there is illustrated the air conditioning system of the present invention. Most notable is the inclusion of a circuit for partially bypassing a portion of the discharge gas from entering the condenser and a discharge gas valve 19 positioned along same. When open, discharge gas valve 19 allows for a portion of the hot gas leaving the compressor to bypass the condenser 13 which can provide enhanced flexibility when dehumidification is required. Dehumidification is often required when relative humidity in the space exceeds desired values. In a preferred embodiment, gas valve 19 is a solenoid valve.

As noted above, prior art implementations making use of a heat exchanger 15, wherein the heat exchanger 15 is configured to contain a sub-cool unit or coil as well, make use of a bypass valve to bypass the sub-cooler coil during normal operation during which there is no need for dehumidification. When a need for dehumidification arises, the normally open bypass valve 21, preferably a solenoid valve, is closed and the subcooling coil in the heat exchanger 15 is activated to yield increased latent capacity and less sensible capacity.

Figure 3:
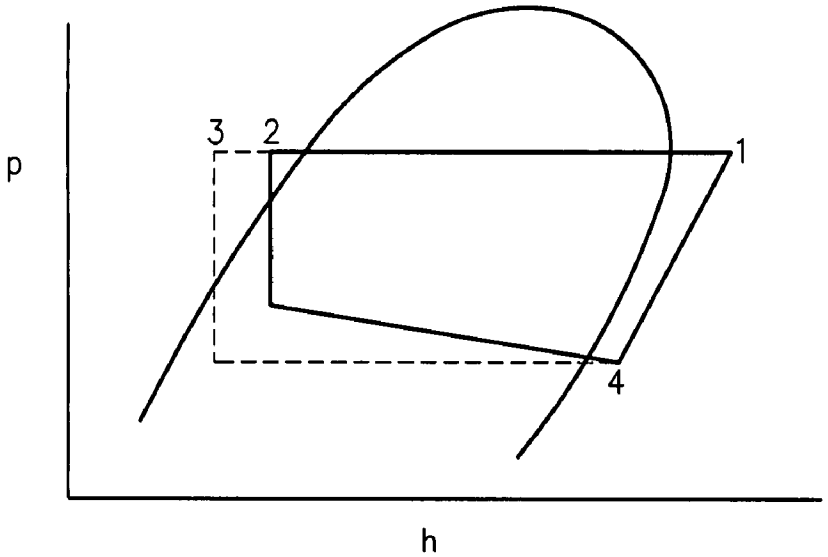
FIG. 3 A graph of pressure vs. enthalpy of the refrigerant flow of the prior art.

With reference to FIG. 3, there is illustrated a plot of enthalpy versus pressure of the refrigerant of a prior art system as it passes through the closed circuit of the air conditioning system 10. Point 4 indicates the entrance to the compressor 11. Traveling from point 4 to point 1, the refrigerant increases in pressure and energy. Moving from point 1 to point 2, the refrigerant moves through the condenser 13 and decreases in enthalpy while maintaining an approximately constant pressure. The pressure of the refrigerant is then lowered until entering the evaporator where the enthalpy increases while maintaining approximately constant pressure until returning to the compressor at point 4.

When solenoid 21 closes, the refrigerant is further cooled from point 2 to point 3 and enters the evaporator at a lower enthalpy. The evaporator then absorbs more energy from the air. However, this energy is returned to the air after it passes over the heat exchanger 15 and thus more latent and less sensible capacity is provided. As noted above, the present invention includes a discharge gas valve 19 which, when open, allows for a portion of the hot gas leaving the compressor to bypass the condenser 13. The bypass gas is mixed with the liquid refrigerant exiting the condenser. The resultant mixture, now two phase, enters the heat exchanger 15 and is condensed and subcooled.

Figure 4:
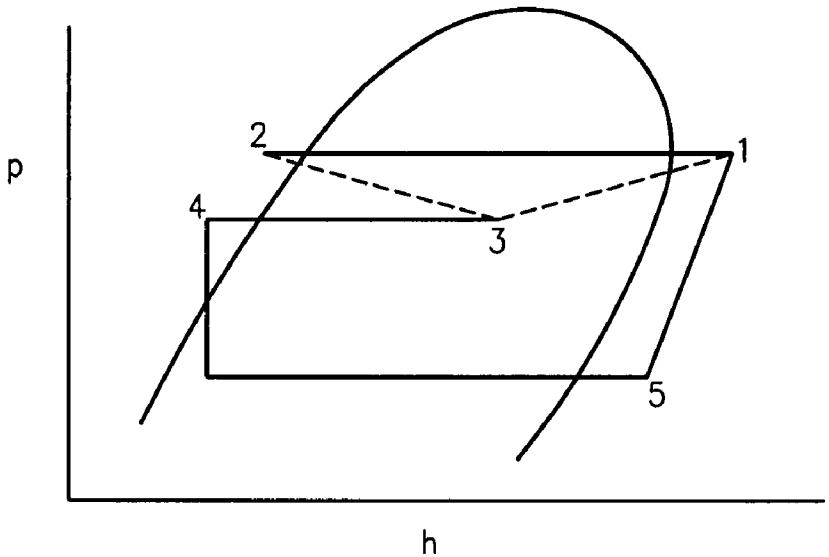
FIG. 4 A graph of pressure vs. enthalpy of the refrigerant flow of the present invention.

With reference to FIG. 4, there is illustrated a plot of enthalpy versus pressure of the refrigerant as it travels the circuit of the present invention when the discharge gas valve 19 is open. Refrigerant enters and exits the compressor at point 5 and continues to point 1 where a portion of the refrigerant continues through the condenser while the remaining portion of the refrigerant bypasses the condenser and continues through discharge gas valve 19. This bypass gas moves from point 1 to point 3. The refrigerant passing through the condenser at point 1 exits the condenser at point 2, mixes with the bypass gas, and proceeds to point 3 at which point, condensing and sub-cooling of the refrigerant and reheat of the air is performed. The refrigerant then proceeds to enter and exit the evaporator and return to the condenser.

As a result, the addition of mixing the hot gas refrigerant with the refrigerant exiting the condenser 13 increases the distance from point 3 to point 4 in FIG. 4 to be greater than the distance from point 2 to point 3 in FIG. 3. The addition of heat to the refrigerant in the present invention negates sensible cooling. Preferably, the amount of refrigerant flowing through discharge gas valve 19 is controlled to yield zero sensible capacity, that is the dry bulb temperature entering the evaporator is equal to the dry bulb temperature leaving the evaporator.

The decision to open, or activate, discharge gas valve 19 depends primarily upon the need for dehumidification in the space to be cooled, the outside air temperature, and the ability to perform subcooling in the heat exchanger 15. When dehumidification is desired with no need for cooling, the air conditioning system 10 operates with discharge gas valve 19 opened to provide for bypass and with bypass valve 21 closed. If dehumidification and cooling is desired and the outside air temperature is low, one must ascertain the availability of an economizer mode whereby dampers are opened to bring in cool outside air. If an economizer is available, it is activated with discharge gas valve 19 opened to provide for bypass and with bypass valve 21 closed. If dehumidification and cooling are desired and the outside air temperature is warm, discharge gas valve 19 is closed, the economizer is closed, and the heat exchanger 15 is operated in the subcooling mode. When dehumidification is not required and cooling is, discharge gas valve 19 is closed and bypass valve 21 is open. By "cool" and "warm", it is meant that the outside air is below or above, respectively, the desired temperature or enthalpy of the air to be cooled by the air conditioning system 10.

In another embodiment of the present invention, a method is provided for determining when to activate the compressor 11, and open and close both discharge gas valve 19 and bypass valve 21 so as to achieve desirable performance. The method by which it is determined under what instances to open and close both discharge gas valve 19 and bypass valve 21 is defined by the table which follows:

| Cooling Stage | OD Temp. | RH | Economizer | Compressor |
|---|---|---|---|---|
| None | Low | Low | Min. OA | Off |
| | | High | Min. OA | Reheat |
| | High | Low | Min. OA | Off |
| | | High | Min. OA | Reheat |
| First | Low | Low | Max. OA | Off |
| | | High | Max. OA | Reheat |
| | High | Low | Min. OA | Standard |
| | | High | Min. OA | Subcooling Mode |
| Second | Low | Low | Min. OA | Standard |
| | | High | Min. OA | Subcooling Mode |
| | High | Low | Min. OA | Standard |
| | | High | Min. OA | Subcooling Mode |

The table above defines the compressor mode in which the air conditioning system 10 of the present invention is operated over a range of variables. These variables include the cooling stage, the outdoor temperature, the relative humidity in the space to be cooled, and the outdoor air requirement. The cooling stage is broken down into three scenarios. In the first cooling stage, labeled "None", there is no need for cooling as the return air temperature of the system is below a cooling setpoint. The cooling setpoint may be set to any desired temperature but is typically between 70° F. and 80° F., preferably approximately 75° F. The second cooling stage, labeled "First" covers the situation where the return air temperature is above the aforementioned cooling setpoint but below the cooling setpoint plus a differential. While the differential may be chosen to achieve a desired range within which the first cooling stage is operative, a typical differential is approximately plus or minus 3° F. Lastly, in the cooling stage labeled "Second", the return air temperature is above the cooling setpoint plus the aforementioned differential.

For each of the above-noted cooling stages, the above included table shows every possible combination of a low or a high outdoor temperature combined with a low or a high relative humidity in the space to be conditioned. The compressor setting is determined from a combination of the cooling stage, the outdoor temperature reading and the relative humidity reading. Possible compressor settings include Off, Reheat, Standard, and Subcooling Mode. When compressor "Off" is appropriate based upon the cooling stage, outdoor temperature, and relative humidity values, it does not matter whether the discharge gas valve 19 or the solenoid 21 is open or closed and the compressor 11 is deactivated. When the compressor "Reheat" mode is determined to be appropriate, discharge gas valve 19 is opened and solenoid 21 is closed. When the compressor "Subcooling Mode" is appropriate, the discharge gas valve 19 is closed as is the solenoid 21. Lastly, when compressor "Standard" is appropriate, the discharge gas valve 19 is closed while the solenoid 21 is opened. With the exception of the "Off" mode, the compressor is activated in all other modes.

Figure 5:
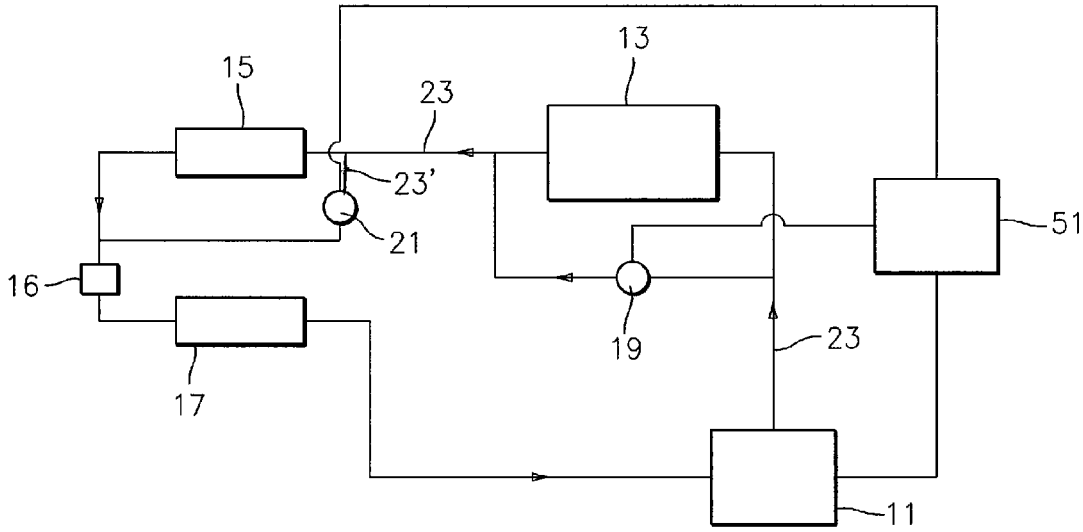
FIG. 5 A diagram of an embodiment of the present invention showing the control module.

With reference to FIG. 5, there is shown the air conditioning system of the present invention with the control module 51. Control module 51 is adapted to receive inputs comprised of the outdoor temperature, return air temperature, relative humidity and cooling stage and, based upon such inputs, to activate/deactivate the compressor 11, as well as open and close the discharge gas valve 19 and solenoid 21 so as to selectively operate the system in the modes discussed above. Control module 51 is any electronic, digital or analog, device adapted, for example, through suitable programming and/or software to receive inputted data and issue control signals to the solenoid 21, gas discharge valve 19 and compressor 11.

As is evident from the table, in each cooling stage mode the outdoor temperature may be either "Low" or "High". While the values for "Low" and "High" may be defined in any manner so as to achieve the desired operation of the discharge gas valve 19 and the solenoid 21, a low outdoor temperature is typically defined to be less than 3° F. below the cooling setpoint while a high outdoor temperature is similarly defined to be an outdoor temperature greater than 3° F. less than the cooling setpoint. In addition, in each cooling stage, for a given outdoor temperature, there are two possible relative humidity settings or variable values, specifically "Low" and "High". The actual value of relative humidity below which relative humidity is considered to be low and above which relative humidity is considered to be high may be chosen to produce a desired compressor setting. Typically, a low relative humidity is considered to be any relative humidity below 55% relative humidity, and, conversely, high relative humidity is considered to be relative humidity above 55% relative humidity. It is sometimes possible to use outdoor air for cooling instead of the compressor when running in an economizer mode. In such a mode, depending upon the outdoor air requirements, there may be utilized either a minimum or a maximum of outdoor air. Thereafter, based upon the measured values of the cooling stage, the outdoor temperature, and the relative humidity, the desired compressor mode of the air conditioning system 10 is determined. Once the compressor mode is established, the operative position of both the discharge gas valve 19 and the bypass valve 21 is defined.

One or more embodiments of the present invention have been described. Nevertheless, it will be understood that various modifications may be made without departing from the spirit and scope of the invention. Accordingly, other embodiments are within the scope of the following claims.

What is claimed is:

1. A method for conditioning air, comprising the steps of:

passing refrigerant through an air conditioning system comprising a continuous refrigerant circuit which flows from a compressor, through a condenser, through a heat exchanger, through an evaporator, and back to said compressor, a condenser bypass circuit having a discharge gas valve for controlling a portion of refrigerant flowing through said condenser bypass circuit, and a heat exchanger bypass circuit having a bypass valve for controlling a portion of refrigerant flowing through said heat exchanger bypass circuit; and treating a stream of air with said air conditioning system by operating said discharge gas valve and said bypass valve based upon outdoor temperature, relative humidity and cooling stage.

2. The method of claim 1, wherein said system can be operated in an off mode wherein said compressor is off, a reheat mode wherein said discharge gas valve is open and said bypass valve is closed, a standard mode wherein said discharge gas valve is closed and said bypass valve is open, and a subcooling mode wherein said discharge gas valve is closed and said bypass valve is closed.

3. The method of claim 2, further comprising operating said system in a mode selected from the following table:

| Cooling Stage | OD Temp. | RH | System Mode |
|---|---|---|---|
| None | Low | Low | Off |
| | | High | Reheat |
| | High | Low | Off |
| | | High | Reheat |
| First | Low | Low | Off |
| | | High | Reheat |
| | High | Low | Standard |
| | | High | Subcooling |
| Second | Low | Low | Standard |
| | | High | Subcooling |
| | High | Low | Standard |
| | | High | Subcooling |

based upon said cooling stage, said outdoor temperature and said relative humidity.

4. The method of claim 1, further comprising determining said cooling stage from no cooling stage, a first cooling stage and a second cooling stage, wherein said no cooling stage is selected when return air temperature is below a cooling setpoint, wherein said first cooling stage is selected when said return air temperature is above said cooling setpoint and below said cooling setpoint plus a differential, and wherein said second cooling stage is selected when said return air temperature is above said cooling setpoint plus said differential.

5. The method of claim 4, wherein said cooling setpoint is between 70° F. and 80° F. and said differential is approximately 3° F.

6. An air conditioning apparatus comprising:

a continuous refrigerant circuit which flows from a compressor, through a condenser, through a heat exchanger, through an evaporator, and back to said compressor, a condenser bypass circuit having a discharge gas valve for controlling a portion of refrigerant flowing through said condenser bypass circuit, and a heat exchanger bypass circuit having a bypass valve for controlling a portion of refrigerant flowing through said heat exchanger bypass circuit; and a control module for operating said discharge gas valve and said bypass valve based upon outdoor temperature, relative humidity and cooling stage.

7. The system of claim 6, wherein said control module is programmed to operate said system in an off mode wherein said compressor is off, a reheat mode wherein said discharge gas valve is open and said bypass valve is closed, a standard mode wherein said discharge gas valve is closed and said bypass valve is open, and a subcooling mode wherein said discharge gas valve is closed and said bypass valve is closed.

8. The system of claim 7, wherein the control module is further programmed to operate said system in a mode selected from the following table:

| Cooling Stage | OD Temp. | RH | System Mode |
|---|---|---|---|
| None | Low | Low | Off |
| | | High | Reheat |
| | High | Low | Off |
| | | High | Reheat |
| First | Low | Low | Off |
| | | High | Reheat |
| | High | Low | Standard |
| | | High | Subcooling |
| Second | Low | Low | Standard |
| | | High | Subcooling |
| | High | Low | Standard |
| | | High | Subcooling |

based upon said cooling stage, said outdoor temperature and said relative humidity.

9. The system of claim 6, wherein the control module is further programmed to determine said cooling stage from no cooling stage, a first cooling stage and a second cooling stage, wherein said no cooling stage is selected when return air temperature is below a cooling setpoint, wherein said first cooling stage is selected when said return air temperature is above said cooling setpoint and below said cooling setpoint plus a differential, and wherein said second cooling stage is selected when said return air temperature is above said cooling setpoint plus said differential.

10. The system of claim 9, wherein said control module is programmed with said cooling setpoint between 70° F. and 80° F. and said differential is approximately 3° F.

* * * * *